US005666099A

United States Patent [19]

Ostrem

[11] Patent Number: 5,666,099

[45] Date of Patent: Sep. 9, 1997

[54] COMPONENT WITH A RIDGID AND A FLEXIBLE ELECTRICAL TERMINATION

[76] Inventor: Fred E. Ostrem, 3463 RFD, Long Grove, Ill. 60047

[21] Appl. No.: 609,190

[22] Filed: Mar. 1, 1996

[51] Int. Cl.[6] ..... H01F 27/29

[52] U.S. Cl. ..... 336/192; 336/107; 439/883

[58] Field of Search ..... 336/68, 107, 192; 439/475, 874, 883

[56] References Cited

U.S. PATENT DOCUMENTS

| | | | |
|---|---|---|---|
| 4,672,348 | 6/1987 | Duve | 336/192 |
| 4,728,916 | 3/1988 | Fontecchio et al. | 336/192 |
| 4,812,601 | 3/1989 | Lothar | 336/192 |
| 5,363,079 | 11/1994 | Zawada et al. | 336/192 |

*Primary Examiner*—Stuart N. Hecker
*Attorney, Agent, or Firm*—Nick Hopman

[57] ABSTRACT

A component, preferably with a large mass like an electromechanical solenoid (101), includes a lead structure (109) to electrically terminate a winding (105) of the solenoid (101). The lead structure (109) is both rigid and flexible. The rigid portion of the lead structure includes an elongated first member (111 ) with a first inner end (113) connected to the winding (105) of the solenoid (101) and a first outer end (115). The flexible portion of the lead structure includes an elongated electrically conductive member (117) with a second inner end (119) connected to the winding (105) of the solenoid (101) and a second outer end (121). The second outer end (121) of the elongated electrically conductive member (117) is coupled to the first outer end (115) of the elongated first member (111). Preferably, the elongated electrically conductive member (117) has a cross-section smaller than a cross-section of the elongated first member (111).

10 Claims, 2 Drawing Sheets

COMPONENT WITH A RIDGID AND A FLEXIBLE ELECTRICAL TERMINATION

FIELD OF THE INVENTION

This invention is generally directed to the field of electrical components and particularly to electrical terminations on those components.

BACKGROUND OF THE INVENTION

Electrical circuits are often deployed in fairly adverse environments. One such adverse environment is in an automobile, or similar vehicle, where vibration can fatigue electrical components and their electrical terminations. These electrical components are often affixed to a substrate positioned within a module that controls the vehicle's powertrain, braking system or other electro-mechanically controllable vehicle subsystem. Since certain parts of these vehicle subsystems have a relatively large mass to control, relatively large mass electro-mechanical components are employed to effect that control. One example of this is a vehicle's anti-lock braking system, where relatively large mass electro-mechanical solenoids are employed to selectively regulate brake fluid pressure. Since these electro-mechanical solenoids are controlled electrically, an electrical interconnection must be made between the solenoids and an electrical control system. The electro-mechanical solenoids are often packaged within a control module and are positioned on a substrate which also hosts the electrical control system comprised of electrical components.

In a vehicular operating environment vibration and shock loads are severe. Vibration behavior can be in the range of 10 to 20 g's and shock loads of 100 g's are not uncommon in the vehicular environment. This operating environment is particularly destructive to relatively large mass components such as the electro-mechanical solenoids because their mass is relatively large compared to the electrical terminations used to electrically connect them to the electrical control system on the substrate. Typically, the electrical terminations will fail causing the system to fail. This is crucial in a safety system such as an automotive braking system.

To circumvent this failure mode, more flexible electrical terminations can be used. However, using electrical terminations flexible enough to withstand the vibration and shock load environment makes assembly of the electro-mechanical solenoids to the substrate difficult because the electrical terminations are not stably positioned during the assembly process.

What is needed is an improved electrical termination or lead structure that allows easy assembly as well as a long field life under a vibration and shock adverse operating environment.

DETAILED DESCRIPTION OF A PREFERRED EMBODIMENT

A component, preferably with a large mass like an electro-mechanical solenoid, includes a lead structure to electrically terminate a winding of the solenoid. The lead structure is both rigid and flexible. The rigid portion of the lead structure enables accurate alignment of the lead structure during an assembly process, and the flexible portion of the lead structure ensures that an electrical connection between the electro-mechanical solenoid and the substrate it is connected to remains intact during high vibration and shock loading.

Figure 1:
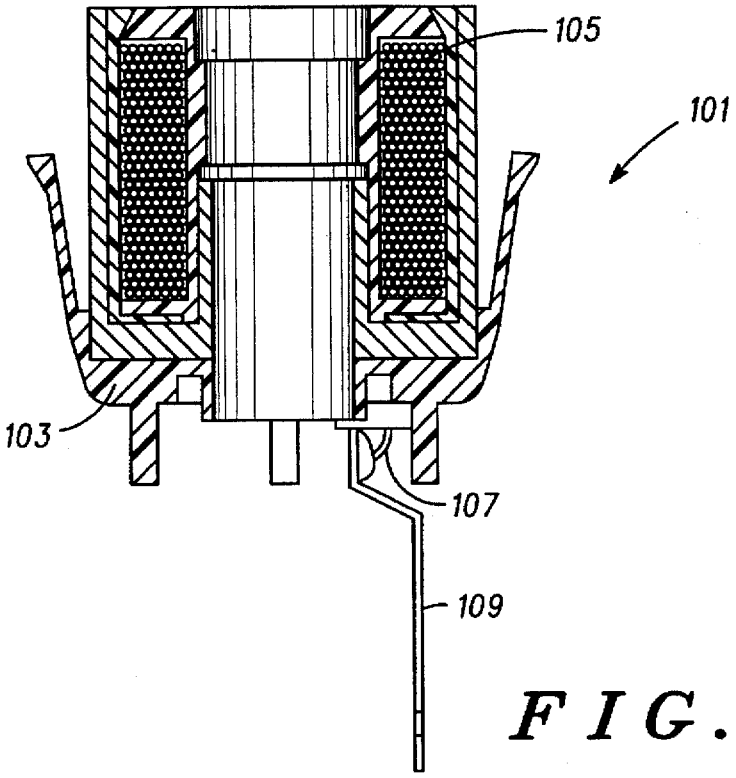
FIG. 1 is a cross-section illustrating an electro-mechanical solenoid in accordance with an embodiment of the invention.

FIG. 1 shows a cross-section of a component 101, here an electro-mechanical solenoid. The electro-mechanical solenoid 101 includes a carrier, or body portion 103 at least partially surround by a winding, or a wire structure, 105 terminated in at least one wire end 107. A rigid-flexible lead structure 109 is attached to the least one wire end 107.

Figure 2:
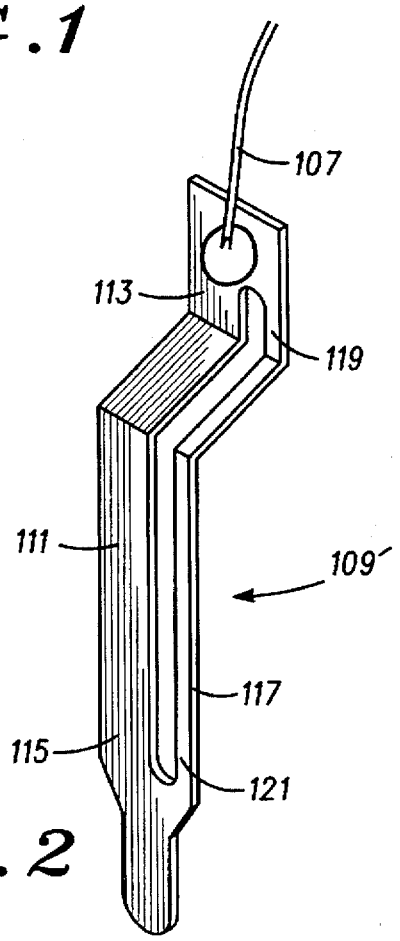
FIG. 2 is a diagram showing details of an electrical lead structure in accordance with an embodiment of the invention.

FIG. 2 shows a first embodiment of the rigid-flexible lead structure 109, here labeled 109'. The rigid-flexible lead structure 109' has an elongated first member 111 with a first inner end 113 connected to the at least one wire end 107. The elongated first member 111 extends away from the wire end 107, and terminates at a first outer end 115. The rigid-flexible lead structure 109' has an elongated electrically conductive member 117 with a second inner end 119. The second inner end 119 is electrically connected to the wire end 107. The elongated electrically conductive member 117 also has a second outer end 121 that is coupled to the first outer end 115 of the elongated first member 111. The elongated electrically conductive member 117 has a cross-section smaller than a cross-section of the elongated first member 111. Preferably, the rigid-flexible lead structure 109' is fabricated from stamped metal. In this case both the elongated first member 111 and the elongated electrically conductive member 117 are electrically conductive.

Figure 4:
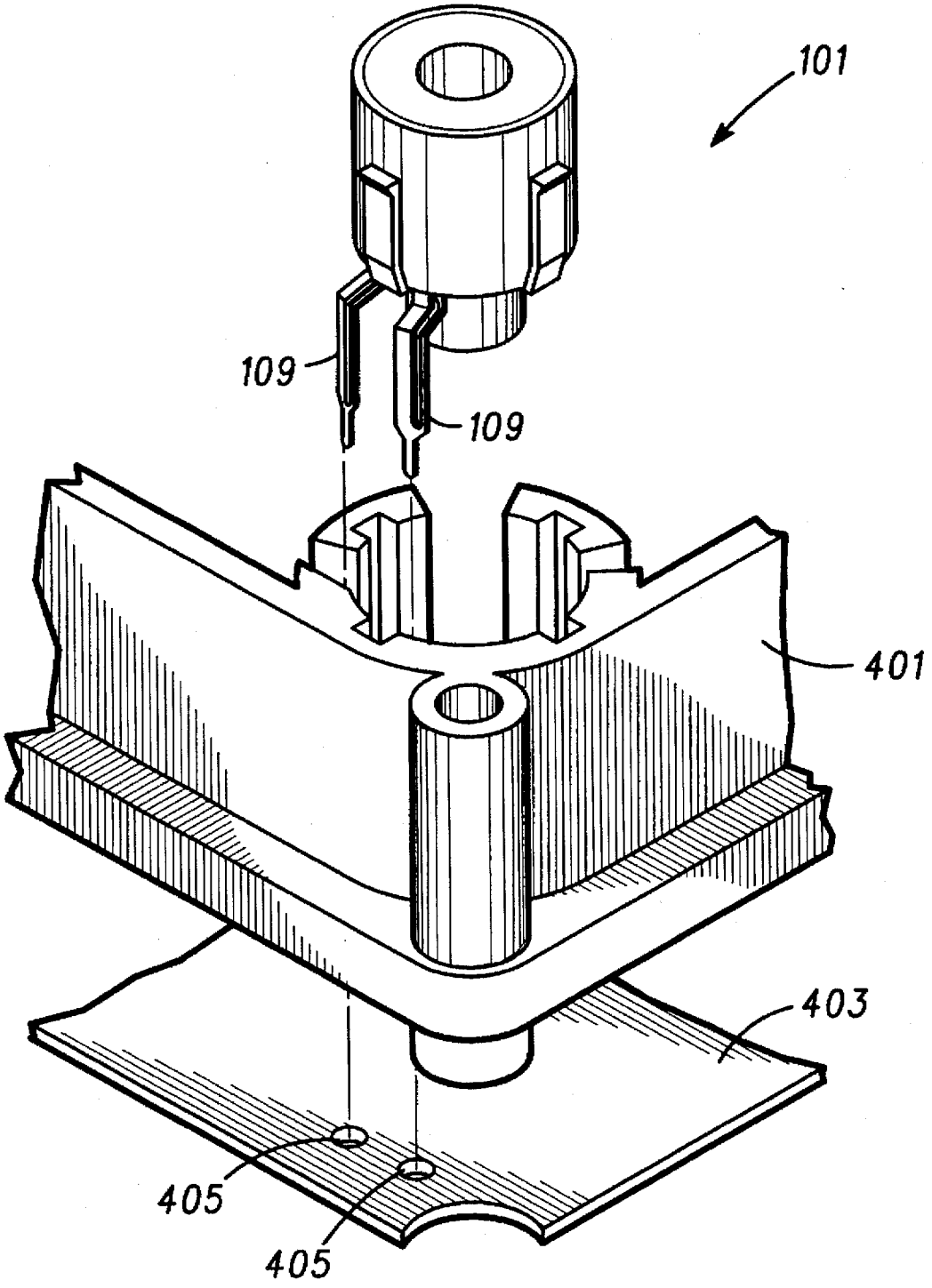
FIG. 4 is a diagram showing assembly details of the electro-mechanical solenoid shown in FIG. 1 to a substrate.

The importance of the design of the rigid-flexible lead structure 109' can be appreciated by reviewing an assembly drawing of the electro-mechanical solenoid 101 during assembly to a substrate. An assembly drawing is shown in FIG. 4.

The electro-mechanical solenoid 101 is assembled through a housing 401 to a substrate 403. Since the lead structure 109 is hidden from view during assembly, it is vital that the lead structure 109 is stiff enough to retain their position to locate within conductive holes 405 during assembly. The relative stiffness of the design of the elongated first member 111 assures this. An advantage of this structure is that given the relative stiffness of the elongated first member 111 the rigid-flexible lead structure 109' of the electro-mechanical solenoid 101 can be accurately inserted onto a substrate, while the relatively flexible elongated electrically conductive member 117 will assure that a vibration/shock-robust electrical connection is maintained between the wire end 107 of the electro-mechanical solenoid 101, the coupled junction of the first outer end 115 and the second outer end 121, and the substrate.

Figure 3:
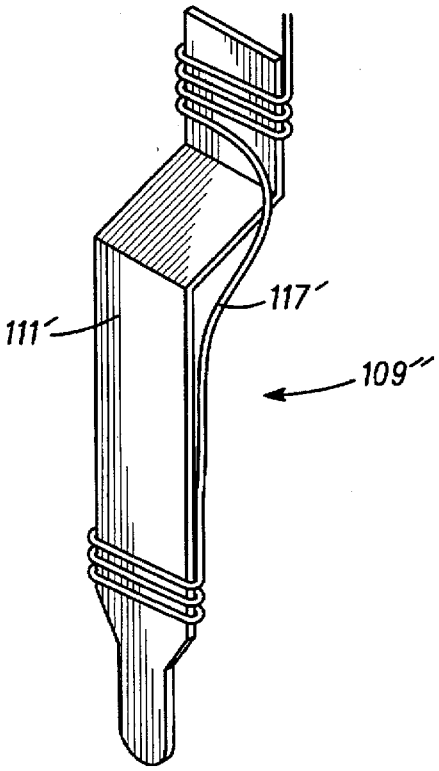
FIG. 3 is a diagram showing details of another electrical lead structure in accordance with another embodiment of the invention.

FIG. 3 is a diagram showing an alternative electrical lead structure in accordance with another embodiment of the invention. Here, a rigid-flexible lead structure 109" has a rigid portion including an elongated first member 111' and a flexible portion including an elongated electrically conductive member 117'. Here the elongated first member 111' is fabricated of a stamped metal piece, and the elongated electrically conductive member 117' is a wire with a much smaller cross section. Alternatively, the elongated first member 111' can be constructed using a relatively large diameter wire having a cross-section large enough to ensure accurate assembly of the electro-mechanical solenoid 101 to the substrate 403.

The rigid portion of the lead structure can also be a non-conductive material such as molded plastic. In this arrangement, the flexible portion would extend beyond the rigid portion and enter a solderable hole in the substrate. Another, variation would provide two holes on the substrate, one to accept the rigid locating (non-conductive) lead portion, and another to accept the flexible lead wire for soldering to the substrate.

The lead structure will remain intact after assembly. However, large displacements of the component will cause fatigue failure of the rigid portion of the structure. The flexible portion of the lead structure then provides the electrical connection and the flexibility required for the large displacements. There will be no impact on the performance or functionality of the component.

In conclusion, advantages of the described approach include a lead structure that can provide rigidity for maintaining lead location relative to the component as needed for automated assembly, and the flexibility as needed for movement of the component relative to the substrate or attachment point during operation to prevent breakage of the lead structure.

What is claimed is:

1. A component comprising:

a body portion;

an elongated first member connected to the body portion, the elongated first member extending away from the body portion and terminating at a first outer end; and an elongated electrically conductive member, electrically connected to the body portion, the elongated electrically conductive member extending away from the body portion and terminating at a second outer end, wherein the second outer end is coupled to the first outer end, and wherein the elongated electrically conductive member has a cross-section smaller than a cross-section of the elongated first member.

2. A component in accordance with claim 1 wherein the elongated first member is electrically conductive and is electrically connected to the body portion.

3. A component in accordance with claim 1 wherein the elongated first member has a first inner end positioned opposite the first outer end, and the elongated electrically conductive member has a second inner end positioned opposite the second outer end, and wherein the first inner end an the second inner end are coupled and the first outer end an the second outer end are coupled.

4. A component in accordance with claim 1 wherein a cross-section of the of the elongated electrically conductive member is one fourth a cross-section of the elongated first member.

5. A solenoid comprising:

a carrier;

a wire structure at least partially surrounding the carrier terminated in at least one wire end; and a rigid-flexible lead structure having an elongated first member with a first inner end connected to the at least one wire end, the elongated first member extending away from the at least one wire end and terminating at a first outer end, the rigid-flexible lead structure having an elongated electrically conductive member with a second inner end electrically connected to the at least one wire end and a second outer end coupled to the first outer end of the elongated first member, wherein the elongated electrically conductive member has a cross-section smaller than a cross-section of the elongated first member.

6. A solenoid in accordance with claim 5 wherein the elongated first member and the elongated electrically conductive member of the rigid-flexible lead structure are constructed of stamped metal.

7. A solenoid in accordance with claim 5 wherein the elongated first member is electrically conductive and is electrically connected to the carrier.

8. A solenoid in accordance with claim 5 wherein the elongated first member and the elongated electrically conductive member are constructed of wire.

9. A solenoid in accordance with claim 5 wherein a cross-section of the elongated electrically conductive member of the rigid-flexible lead structure is one fourth a cross-section of the elongated first member of the rigid-flexible lead structure.

10. A solenoid in accordance with claim 9 wherein the elongated first member and the elongated electrically conductive member of the rigid-flexible lead structure are constructed of stamped metal.

* * * * *